US006769447B2

(12) United States Patent
James

(10) Patent No.: US 6,769,447 B2
(45) Date of Patent: Aug. 3, 2004

(54) GAS CONTROL ASSEMBLY

(75) Inventor: Dale Peter James, Frankston (AU)

(73) Assignee: Advanced Products PTY LTD, Carrum Downs (AU)

( * ) Notice: Subject to any disclaimer, the term of this patent is extended or adjusted under 35 U.S.C. 154(b) by 0 days.

(21) Appl. No.: 10/071,208

(22) Filed: Feb. 11, 2002

(65) Prior Publication Data

US 2002/0098455 A1 Jul. 25, 2002

Related U.S. Application Data

(63) Continuation of application No. PCT/AU00/00949, filed on Aug. 9, 2000.

(30) Foreign Application Priority Data

Aug. 9, 1999 (AU) ..... PQ 2140

(51) Int. Cl.[7] ..... F23D 5/16; F23D 14/72; F23Q 9/12; F16K 3/02

(52) U.S. Cl. ..... 137/66; 431/54

(58) Field of Search ..... 137/65, 66; 431/54, 431/59, 60

(56) References Cited

U.S. PATENT DOCUMENTS

| | | | | | |
|---|---|---|---|---|---|
| 2,409,947 | A | * | 10/1946 | Mantz | 137/66 |
| 2,513,705 | A | * | 7/1950 | Arden | 137/66 |
| 2,588,179 | A | * | 3/1952 | Thornberry | 137/66 |
| 2,920,693 | A | * | 1/1960 | Thornberry | 137/66 |
| 3,002,519 | A | * | 10/1961 | Wright et al. | 137/66 |
| 3,550,603 | A | * | 12/1970 | Scheuler | 137/66 |
| 3,597,138 | A | * | 8/1971 | Ray | 137/66 |
| 3,875,956 | A | * | 4/1975 | Katachka | 137/66 |
| 4,125,356 | A | | 11/1978 | Ohashi et al. | 431/76 |
| 4,242,080 | A | * | 12/1980 | Tabei | 431/54 |
| 4,437,830 | A | | 3/1984 | Harris et al. | 431/54 |
| 4,543,974 | A | * | 10/1985 | Dietiker et al. | 137/66 |
| 5,094,259 | A | * | 3/1992 | Hsu | 137/66 |
| 5,799,681 | A | | 9/1998 | Velie et al. | 137/1 |

FOREIGN PATENT DOCUMENTS

| | | |
|---|---|---|
| DE | 4316584 C1 | 9/1994 |
| DE | 19607840 C1 | 7/1997 |
| EP | 0889266 A2 | 1/1999 |
| FR | 2221693 | 10/1974 |
| GB | 2196732 A | 5/1988 |
| GB | 2 242 257 | 2/1991 |
| WO | WO92/03679 | 3/1992 |

* cited by examiner

*Primary Examiner*—George L. Walton
(74) *Attorney, Agent, or Firm*—Jacobson Holman PLLC

(57) ABSTRACT

A gas control assembly for controlling supply of fuel gas to a gas burner. The assembly includes a housing having an elongate body with a longitudinally extending gas flow passage, an inlet into the passage for gas communication with a manifold, and an outlet from the passage for directing a regulated flow of gas from the manifold to the burner. A safety valve is mounted in a valve chamber, within the gas flow passage, an is operable to control flow of gas through the gas flow passage from the inlet toward the outlet. An actuating member is mounted in the passage for guided movement along the passage to operate the valve. A regulator valve is mounted in a further valve chamber in the body and is operable to regulate flow of gas to the outlet. The regulator valve lies in a plane containing the longitudinal axis of the gas flow passage.

41 Claims, 3 Drawing Sheets

GAS CONTROL ASSEMBLY

This is a continuation of PCT AU00/00949 filed Aug. 9, 2000 and published in English.

FIELD OF THE INVENTION

The present invention relates generally to an assembly for control of gas flow. More particularly, the present invention relates to an assembly for controlling the flow or supply of fuel gas to a gas burner, as well as to particular components of that assembly including the assembly housing.

BACKGROUND TO THE INVENTION

In gas fuelled barbecues, stoves, cookers and cook tops, the gas flow control assembly typically includes a manifold through which the gas fuel is supplied to the apparatus, and a control valve assembly connected to and mounted on the side of the manifold which is used to regulate the flow of gas to the burners. Generally, a separate valve assembly is provided for each burner. Accordingly, the manifold and valve assemblies are often connected via a tube or hose, through which the gas flows from the manifold to the valve assemblies.

It is important that such valve assemblies are of robust construction so that they will withstand impacts and the like to be expected during manufacture, assembly and use. Because of this, strength impact tests have been designed for valve assemblies. In one such test, the body of a valve assembly must withstand an impact from a 10 kg mass swung on a pendulum rod 1 meter in length from a height of 1.4 meters. As a result, existing safety valve assemblies tend to be quite bulky, with the strength of a valve assembly being dictated by its overall size.

Various attempts have been made to manufacture a valve assembly which automatically shuts off the supply of gas in response to the flame of a corresponding burner being accidentally or inadvertently extinguished, as might occur with a gust of wind blowing passed the flame. However, these attempts have produced valve assemblies of complicated design and construction. As a result, those valve assemblies are generally difficult and time consuming to manufacture and assemble, with commensurate high production costs.

It would therefore be desirable to produce a gas control assembly which is more compact in size, and yet is simple and inexpensive to manufacture and assemble. Moreover it would be desirable to produce a gas control assembly with a reduced number and less complicated components, thereby leading to a reduction in manufacturing costs.

SUMMARY OF THE INVENTION

According to one aspect of the present invention, there is provided a housing of a gas control assembly for use with a gas burner, the housing including a body having a gas flow passage, an inlet into the gas flow passage for gas communication with a manifold, and an outlet from the gas flow passage for directing a regulated flow of gas from the manifold to the burner, the gas flow passage having a valve chamber for securing a safety valve operable to control flow of gas through the gas flow passage from the inlet to the outlet, and the gas flow passage having a guideway for receiving an actuating member for guided movement therealong in order to operate the safety valve.

According to another aspect of the present invention, there is provided a housing of a gas control assembly for use with a gas burner, the housing including an elongate body having a longitudinally extending gas flow passage, the gas flow passage including an elongate valve chamber, an inlet into the gas flow passage for gas communication with a manifold, an outlet from the gas flow passage for directing a regulated flow of gas from the manifold to the burner, an access opening into the gas flow passage for insertion of an elongate safety valve into the valve chamber for extending coaxially within the gas flow passage, the safety valve being operable to control flow of gas along the gas flow passage from the inlet to the outlet, and a further valve chamber in the body for receiving a regulator valve operable to regulate flow of gas to the outlet, the further valve chamber lying in a plane containing the longitudinal axis of the gas flow passage.

According to yet another aspect of the present invention, there is provided a housing of a gas control assembly for use with a gas burner, the housing including a body having a gas flow passage, an inlet into the gas flow passage for gas communication with a manifold, and an outlet from the gas flow passage for directing a regulated flow of gas from the manifold to the burner, the gas flow passage having a valve chamber for receiving a safety-valve operable to control flow of gas through the gas flow passage from the inlet to the outlet, the body being manufactured from metal bar stock material.

According to a further aspect of the present invention, there is provided a gas control assembly for use with a gas burner, the control assembly including: a housing including an elongate body having a longitudinally extending gas flow passage, an inlet into the gas flow passage for gas communication with a manifold, and an outlet from the gas flow passage for directing a regulated flow of gas from the manifold to the burner, a safety valve mounted in the gas flow passage and operable to control flow of gas through the gas flow passage from the inlet to the outlet; and, an actuating member mounted in the gas flow passage for guided movement therealong in order to operate the safety valve.

According to a still further aspect of the present invention, there is provided a gas control assembly for use with a gas burner, the control assembly including: a housing including an elongate body having a longitudinally extending gas flow passage, the gas flow passage including an elongate valve chamber, an inlet into the gas flow passage for gas communication with a manifold, and an outlet from the gas flow passage for directing a regulated flow of gas from the manifold to the burner, and a further valve chamber in the body; a safety valve mounted in the valve chamber and operable to control flow of gas through the gas flow passage from the inlet toward the outlet; and, a regulator valve mounted in the further valve chamber and operable to regulate flow of gas to the outlet, the regulator valve lying in a plane containing the longitudinal axis of the gas flow passage.

Preferably, the outlet communicates with, and extends laterally from, the guideway. Preferably, the inlet communicates with and extends laterally from the valve chamber. In at least one preferred embodiment the inlet and outlet extend laterally from opposite sides of the gas flow passage. The inlet and outlet are spaced apart along the gas flow passage, in at least one preferred embodiment.

Preferably, the valve chamber is axially aligned with the guideway on the longitudinal axis of the gas flow passage.

Preferably, the housing includes a bore in the body opening into the guideway for receiving a control member for guided movement therealong in order to move the actuating member for operation of the safety valve. The bore preferably extends laterally from the guideway.

Preferably, the further valve chamber opens into the gas flow passage adjacent the outlet. Moreover, the further valve chamber preferably extends laterally from the gas flow passage.

In at least one preferred embodiment, the further valve chamber extends parallel to the bore. That further valve chamber and bore are spaced apart along the longitudinal axis of the gas flow passage in that one embodiment.

In at least one preferred embodiment, the body is machined from metal bar stock material. In that embodiment, the body is preferably manufactured from bar stock material having a square or rectangular transverse cross sectional shape.

In alternative embodiments, the body can be manufactured by die casting or forging from metal material.

Preferably, the guideway is configured for receiving the actuating member for sliding movement therealong. Preferably, the guideway is of a cylindrical cross sectional shape, and extends on the longitudinal axis of the gas flow passage.

Preferably, the actuating member is mounted in the guideway for guided sliding movement thereby to operate the safety valve. In at least one embodiment, the actuating member is an actuating spool. In one embodiment, the spool has at least one port therethrough for flow of gas along the gas flow passage from the inlet to the outlet. The spool in one embodiment has an actuating surface at one end thereof which abuts the safety valve for movement of that valve.

In one preferred embodiment, the spool is made from cylindrical tube or pipe. In this embodiment, the tang is formed by angling a portion of the cylindrical sidewall inwardly.

In another preferred embodiment, the spool is made from a metal plate such as mild steel. However, it is to be appreciated that other materials could be used. If made from plate, the plate would then be bent or otherwise formed into an approximately tubular shape to provide the spool. In this embodiment, it would not be necessary that the plate edges meet to form an enclosed spool. Forming the spool of metal plate may reduce its manufacturing cost.

These embodiments provide a spool with a central port therethrough requiring minimal material. However, it is to be appreciated that the spool need not be hollow. If this was the case however, then alternative means would be required to allow the passage of gas.

In an alternative embodiment, the actuating spool includes a central solid longitudinal core around which the gas is capable of flowing. To maintain the core coaxial with the guideway, guide arms extend radially from the core and slidingly engage with the guideway.

In these embodiments, the actuating spool and core are separate from the valve.

In other preferred embodiments, the actuating member is connected to or formed integral with the safety valve for guided movement therewith along the passage.

Preferably, the control member is operable externally of the housing to move the actuating member to effect operation of the safety valve. In at least one preferred embodiment, the control member includes a control rod mounted in the bore for longitudinal sliding movement in order to engage the actuating spool for movement thereof. The actuating spool preferably has a control surface, and the control rod contacts that control surface for movement of the actuating spool.

Preferably, the actuating member and control member are slidably movable along respective axes extending perpendicular to one another. The regulator valve preferably lies in a plane containing the longitudinal axis of the gas flow passage.

Preferably, the regulator valve includes an elongate control key movable on a longitudinal axis to operate the regulator valve for regulating flow of gas. The control key longitudinal axis preferably extends in the plane with the longitudinal axis of the gas flow passage.

BRIEF DESCRIPTION OF THE DRAWINGS

The following description refers to preferred embodiments of the gas flow control assembly of the present invention. To facilitate an understanding of the invention, reference is made in the description to the accompanying drawings where the assembly and its components are illustrated in some of the preferred embodiments. It is to be understood that the assembly and components are not limited to the preferred embodiments as hereinafter described and as illustrated in the drawings.

In the drawings, where the same reference numerals identify the same or similar components.

DETAILED DESCRIPTION OF THE PREFERRED EMBODIMENTS

Figures 1, 2:
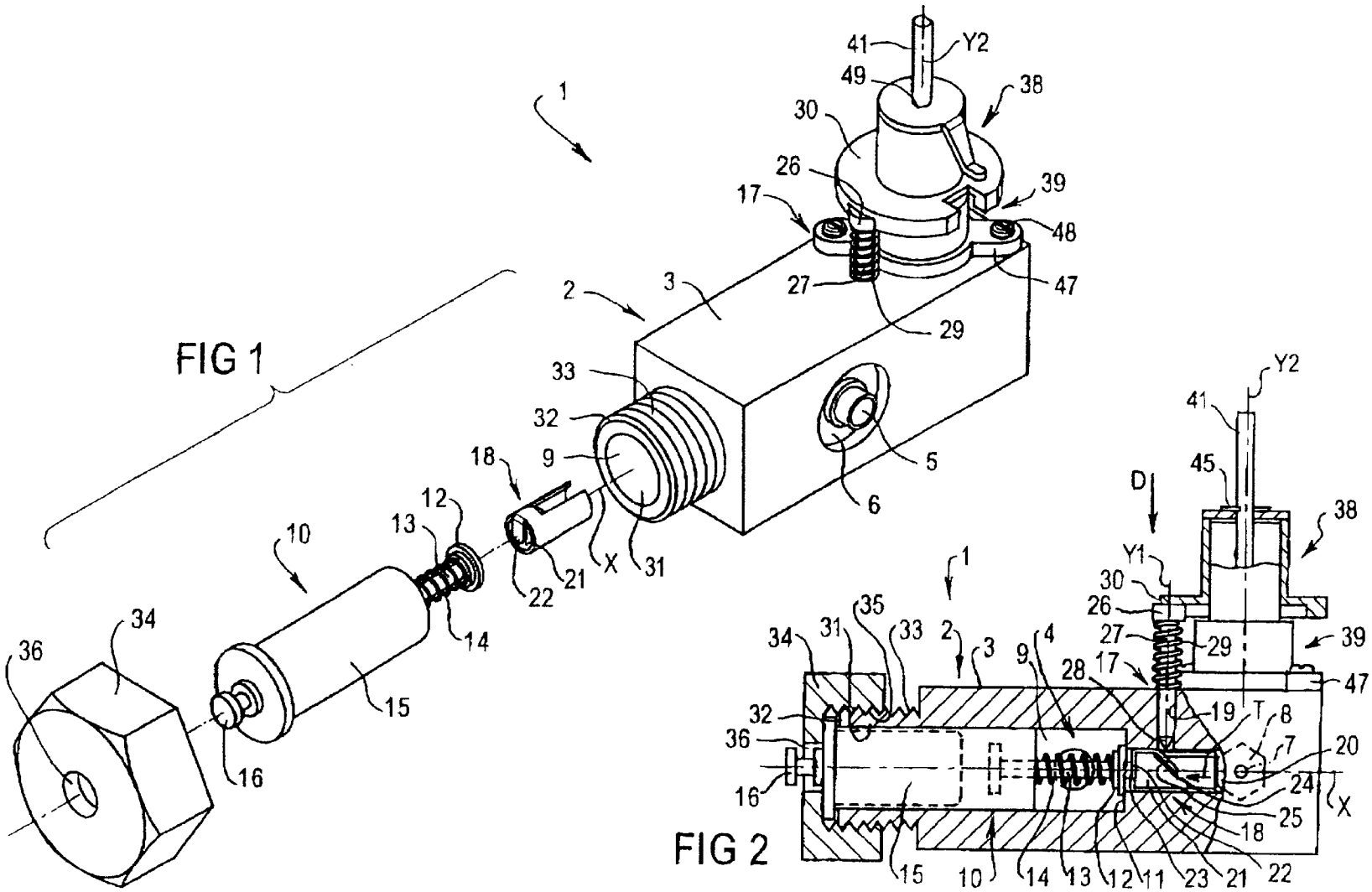
FIG. 1 is a partially exploded perspective view of a gas flow control assembly according to one preferred embodiment of the present invention.
FIG. 2 is a partial cross-sectional side view of the control assembly of FIG. 1 when assembled, and with the safety valve in a closed position.
Figure 3:
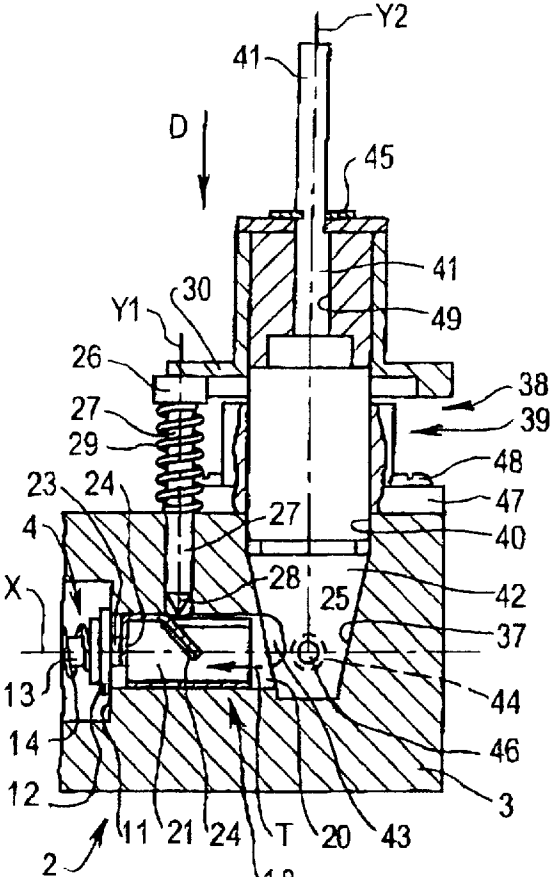
FIG. 3 is a partial cross-sectional side view of part of the assembled control assembly of FIG. 2, but with the safety valve in an open position.

Referring initially to FIGS. 1 to 3 of the drawings, there is generally shown an assembly 1 for controlling a supply of gaseous fuel to at least one burner (not illustrated) of a cook top (not illustrated).

The gas control assembly 1 includes a housing 2 having an elongate housing body 3. The housing body 3 is manufactured from metal bar stock material, such as extruded aluminium square bar. The body 3 has a longitudinal axis X.

The housing body 3 has a gas flow passage 4 within the body 3. The passage 4 is elongate and extends straight along the longitudinal axis X. The body 3 also has an inlet 5 into the gas flow passage 4 for gas communication with a manifold M (see FIG. 4). A recess 6 is provided in an outer wall of the housing body 3 surrounding the inlet 5. The recess 6 provides accommodation for sealing means in the form of an O-ring (not illustrated) to seal the connection between an outlet port (not illustrated) of the manifold M and the inlet 5.

The body 3 also has an outlet 7 from the gas flow passage 4 for directing a regulated flow of gas from the manifold M to the burner. The outlet 7 has an internal screw thread (not illustrated) and is fitted with an injection nozzle 8 for directing and accelerating the gas toward the burner.

The inlet 5 and outlet 7 are axially spaced apart along the gas flow passage 4 and extend laterally from diametrically opposite sides of the passage 4. In other embodiments, the inlet 5 and outlet 7 may extend from different sides or the same sides of the passage 4.

Gas can flow along the passage 4 from the inlet 5 to the outlet 7. In order to control that flow the passage 4 has an elongate and enlarged valve chamber 9 in which safety valve 10 is mounted. A valve seat 11 is provided in the valve chamber 9, between the inlet 5 and outlet 7, and the safety valve 10 is co-operable with the seat 11 to control gas flow along passage 4.

The safety valve 10 includes a safety gas cutoff device, which communicates with and, in use of the assembly 1, monitors the temperature of the associated gas burner (not shown). When the valve 10 senses that the associated burner is lit, the safety valve 10 will move to and remain in an open position (as shown in FIG. 3) so that gas can flow from the inlet 5, through the valve seat 11 toward the outlet 7. However, if the burner is inadvertently extinguished, then the safety gas cutoff device senses the reduction in burner temperature and automatically moves the safety valve 10 to a closed position (as shown in FIG. 2), thereby preventing gas from being fed to the (now unlit) burner. In this way the potentially dangerous and harmful effects of gas leakage are avoided.

The safety valve 10 includes a valve closure member 12 for seating against the valve seat 11. The valve closure member 12 is mounted on valve stem 13 for axial movement along the longitudinal axis X toward and away from the valve seat 11, and is biased toward the valve seat 11 into the valve closed position by coil spring 14 surrounding stem 13. Movement of the valve closure member 12 away from the valve seat 11 to the open position is effected by energisation of an electromagnet 15. The electromagnet 15 is connected to a sensor which senses when the burner is lit by the heat generated by the burner flame. In this embodiment, the sensor is in the form of a bimetallic switch or strip (not illustrated), which is in circuit with the electro magnet 15 and connects with valve terminal 16. When the burner is lit, a small current (typically in the range of a few milli-Amps) is generated in the circuit energising a coil (not shown) of the valve electro magnet 15 to generate an electro-magnetic force. That force overcomes the biasing force applied to the valve closure member 12 by the spring 14 to move the safety valve 10 to the open position. When the burner flame is accidentally extinguished, the current ceases and the valve 10 closes under action of the spring 14.

To enable gas to flow through the gas flow passage 4 to the burner when lighting the burner, the assembly 1 includes a manually operable control rod 17 and actuating spool 18 for moving the valve 10 to its open position. The control rod 17 is mounted in a bore 19 in housing body 3 for longitudinally sliding movement along axis $Y_1$. Longitudinal axis $Y_1$ extends perpendicular to, but is contained in the same plane as, longitudinal axis X.

The actuating spool 18 is mounted in a guideway 20 in the gas flow passage 4 for guided sliding movement therealong on longitudinal axis X. The spool 18 has an axial port 21 therethrough for flow of gas along the gas flow passage 4. The spool 18 also has a tab 22 at one end thereof providing an actuating surface 23, and a tang 24 spaced from the one end providing a sloped or cammed control surface 25. The tang 24 is provided at the approximate mid-axial length of the spool 18 to assist in the smooth sliding of the spool 18 in the guideway 20. The angle of the control surface 25 can be selected to suit the intended distance of movement of the spool 18.

When moved in direction D along axis $Y_1$, the control rod 17 engages the control surface 25, that engagement producing a corresponding sliding movement of the actuating spool 18 in direction T. Comparing FIGS. 2 and 3, the actuating spool 18 moves to the left from the position illustrated in FIG. 2 to the position illustrated in FIG. 3 during that movement of the control rod 17. In this position, the spool 18 abuts and moves the valve closure member 12 against the bias of the spring 14 out of sealing engagement with the valve seat 11, so as to open the safety valve 10 and allow gas to flow through the gas flow passage 4.

The control rod 17 has an enlarged head 26, and a shaft 27 extending from the head 26 and terminating in a profiled control end 28. A coil spring 29 surrounds the shaft 27 and extends between the head 26 and an outer surface of the housing body 3. The spring 29 acts to bias the control rod 17 in a direction opposite to direction D away from the actuating spool 18. A press member 30 limits that movement and so prevents the control rod 17 from being removed from the bore 19. Press member 30 is also movable in order to depress the control rod 17, as wilt be described in more detail hereinafter.

Housing body 3 includes an access opening 31 at one end 32 thereof which opens into the gas flow passage 4. That access opening 31 enables mounting of the valve 10 in the valve chamber 9, and positioning of the actuating spool 18 in the guideway 20.

A screw threaded connection 33 is provided on the body end 32, and the housing 2 has a retaining cap 34 with a screw thread connection 35 for interconnecting with the end 32 of the body 3. The retaining cap 34 co-operates with the valve 10 to close the access opening 31, and also acts to retain the valve 10 in the valve chamber 9.

The retaining cap 34 has an aperture 36 exposing the valve terminal 16 for connection into the sensor circuit without disturbing the gas tight closure of the access opening 31. A plastic cover (not shown) may be placed over the end of the retaining cap 34 so as to protect the terminal 16.

The housing body 3 also includes a further valve chamber 37 communicating with the gas flow passage 4, and in particular the junction between the guideway 20 and the outlet 7. A regulator valve 38 is mounted in the valve chamber 37 and is operable to regulate flow of gas in the guideway 20 to the outlet 7.

The regulator valve 38 includes a cap member 39 which covers an access opening 40 into the chamber 37. The cap member 39 holds an elongate rotatable control key 41 in operative association with a rotatable flow-regulating plug member 42 located in the valve chamber 37. The plug member 42 includes an inlet orifice 43 which can communicate with the gas flow passage 4, and an outlet orifice 44 which can communicate with outlet 7. In use of the control assembly 1, gas flows through the inlet orifice 43 from guideway 20 and through the outlet orifice 44 to the outlet 7.

The control key 41 extends along longitudinal axis $Y_2$ which is parallel to axis $Y_1$ and in the same plane as axes X and $Y_1$. With this arrangement the plug member 42 is aligned with the gas flow passage 4 so that there is a smooth gas flow path from the passage, through the plug member 42 to the outlet 7.

Depression of the control key 41 toward the plug member 42 along axis $Y_2$, against the bias of a spring (not illustrated), causes the control key 41 to engage the plug member 42 such that subsequent rotation of the control key 41 about axis $Y_2$ rotates the plug member 42 to vary the volume rate of gas flow through the gas flow passage to the outlet 7.

Press member 30 is carried on control key 41 for depression with the control key 41 in order to depress the control rod 17. The press member 30 is slidably mounted on the control key 41 and retained thereon by clip 45 fitted to the control key 41, the press member 30 being urged against the clip 45 by the bias applied by spring 29 to control rod 17.

The regulator valve 38 also includes simmer orifice 46. By rotating the regulator valve 38 clockwise about axis $Y_2$ by approximately 90 degrees relative to the housing 2, outlet orifice 44 communicates with the outlet 7, and the simmer orifice 46 communicates With the guideway 20. In this arrangement, the flow of gas to the burner is reduced. The size of simmer orifice 46 is adjustable via an adjuster (not shown) provided in the regulator valve 38.

This operation of the regulator valve 38 will be readily understood by persons skilled in the art and, as such, will not be further described here.

The cap member 39 includes a cover portion 47 for extending over and covering the access opening 40. The cover portion 47 is attached to the body 3 with screw threaded fasteners 48, and has a hole 49 therethrough for passage of the control key 41.

Figure 4:
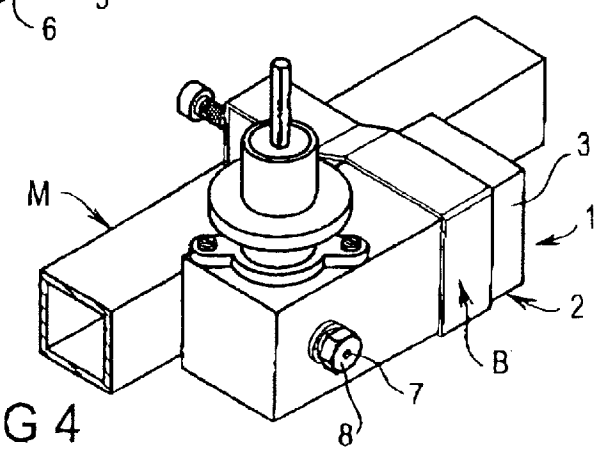
FIG. 4 is a perspective view of the gas control assembly of FIG. 1 when assembled and mounted on a manifold.

Mounting of the control assembly 1 to a manifold M is shown in FIG. 4. That mounting is achieved with a retaining bracket B. The manifold M includes an outlet orifice (not shown) which supplies gas to the inlet 5 of the housing body 3. As previously discussed, the manifold outlet orifice and inlet 5 sealingly connect via an O-ring (not illustrated) placed in the recess 6.

Figure 5:
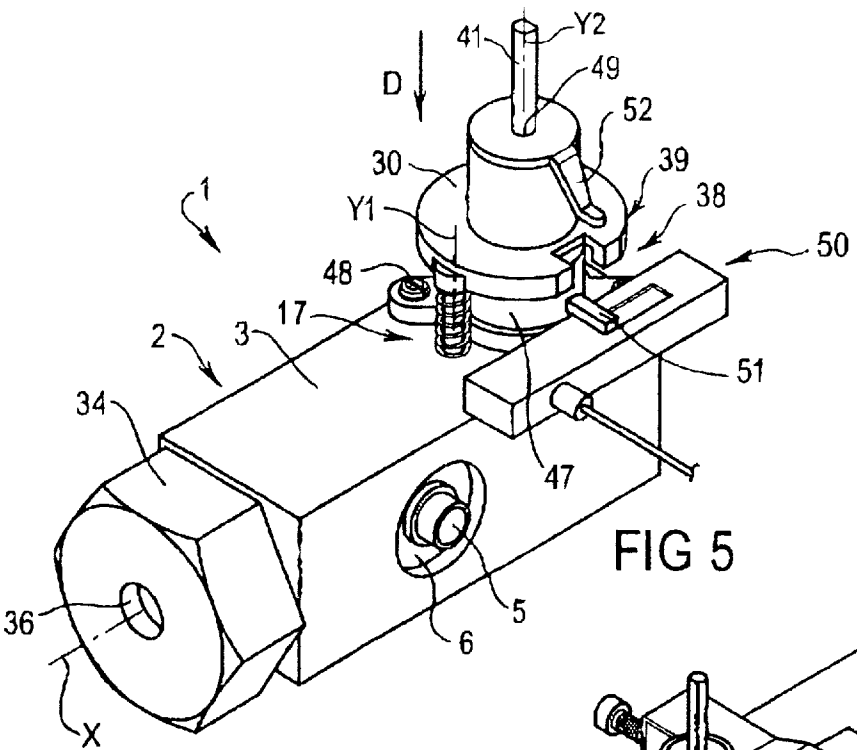
FIG. 5 is a perspective view of the gas control assembly of FIG. 1 when assembled, and modified to include a piezoelectric starter; and, FIG. 6 is a partially exploded perspective view of the gas control assembly of FIG. 1, but incorporating a modified cap member, and including a micro-switch starter.

FIG. 5 illustrates a modified form of the control assembly 1 which includes a piezoelectric starter 50. The starter 50 provides a spark to ignite the burner. The starter 50 is retained in place on the valve assembly housing 2 by a bracket (not shown) which is placed over cap member 39. The starter 50 includes a slider 51 which generates the ignition spark. The slider 51 is moved via a striker arm 52. It is to be appreciated that instead of the illustrated starter 50, other forms of starters may be used, including an electronic starter operated by, for example, a push button.

Figure 6:
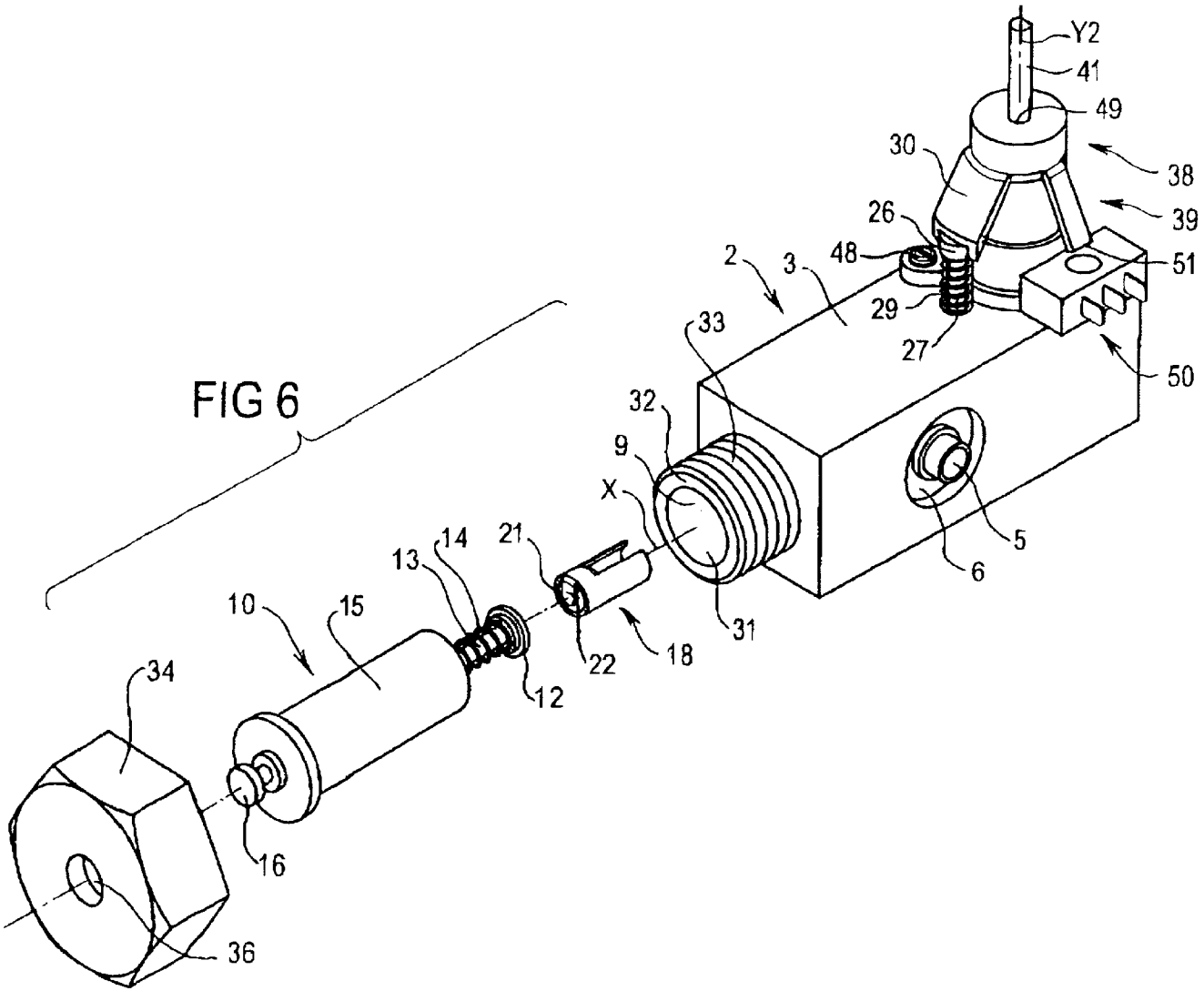

The control assembly embodiment illustrated in FIG. 6 is similar to that of FIG. 1, but includes a different cap member 39. In addition, the assembly 1 includes a starter 50 in the form of a micro-switch. Cap member 39 requires less material and is therefore cheaper to manufacture than the cap member of the previous valve assembly embodiments.

The control assembly of the present invention has a housing body which can be readily manufactured from stock aluminium square or rectangular bar extrusion.

The present invention provides a simplified arrangement of the inlet and outlet of the control assembly, which produces a simplified and easy to manufacture control assembly. This advantageously produces a smaller control assembly when compared to prior arrangements.

In addition the simplified housing body improves gas flow through the gas flow passage. The passage is not tortuous so that loss of pressure in the gas flow due to turbulence through the passage is reduced.

The simplified control assembly according to the invention are more aesthetically pleasing, and provides a neat appearance when mounted to a manifold.

Moreover, by securing the control assembly directly to the manifold, the gas-tight connection between to two components can be simply effected by providing a seal around the connection between the manifold outlet and the control assembly inlet.

Finally, it is to be appreciated that various alterations, modifications and/or additions may be made to the particular construction and arrangement of parts previously described without departing from the ambit of the invention as defined in the claims appended hereto.

What is claimed is:

1. A housing of a gas control assembly for use with a gas burner, the housing adapted for mounting in communication with a gas manifold, said housing comprising an elongate body having a gas flow passage extending along a longitudinal axis of the body, an inlet into the gas flow passage for gas communication with the manifold, and an outlet from the gas flow passage for directing a regulated flow of gas from the manifold to the burner, wherein the gas flow passage has a valve chamber for receiving a safety valve operable to control flow of gas through the gas flow passage from the inlet to the outlet, wherein the gas flow passage has a guideway for receiving an actuating member for guided movement therealong in order to operate the safety valve, wherein the housing body includes a bore therein that is lateral to the guideway and opens into the guideway for receiving a control member for guided movement therealong in order to move the actuating member for operation of the safety valve; wherein the housing also including a further valve chamber in the body opening into the gas flow passage for receiving a regulator valve operable to regulate flow of gas to the outlet, wherein the further valve chamber extends laterally from the gas flow passage, and wherein the further valve chamber and bore are spaced apart along the longitudinal axis of the gas flow passage.

2. The housing as claimed in claim 1, wherein the guideway is configured for receiving the actuating member for sliding movement therealong.

3. The housing as claimed in claim 1, wherein the guideway is of a circular cross sectional shape, and extends on the longitudinal axis of the gas flow passage.

4. The housing as claimed in claim 1, wherein the outlet communicates with the guideway.

5. The housing as claimed in claim 1, wherein the further valve chamber opens into the gas flow passage adjacent the outlet, and the outlet extends laterally to the guideway.

6. The housing as claimed in claim 1, wherein the inlet communicates with the safety valve chamber.

7. The housing as claimed in claim 1, wherein the inlet extends laterally from the safety valve chamber.

8. The housing as claimed in claim 1, wherein the inlet and outlet extend laterally from opposite sides of the gas flow passage.

9. The housing as claimed in claim 1, wherein the body is manufactured from metal bar stock material.

10. The housing as claimed in claim 9, wherein the body is machined from metal bar stock material.

11. The housing as claimed in claim 9, wherein the body is manufactured from bar stock material having a square or rectangular transverse cross sectional shape.

12. The housing as claimed in claim 9, wherein the body is manufactured from aluminium or aluminium alloy.

13. The gas control assembly for use with a gas burner, the control assembly including a housing as claimed in claim 1.

14. The gas control assembly for use with a gas burner, the control assembly adapted for mounting in communication with a gas manifold, the gas control assembly comprising a housing including an elongate body having a longitudinally extending gas flow passage, an inlet into the gas flow passage for gas communication with the manifold, and an outlet from the gas flow passage for directing a regulated flow of gas from the manifold to the burner, wherein a safety valve is mounted in the gas flow passage and is operable to control flow of gas through the gas flow passage from the inlet to the outlet; wherein an actuating member is mounted in the gas flow passage for guided movement therealong in order to operate the safety valve, wherein the housing body includes a bore that extends laterally to the gas flow passage and opens into the gas flow passage, a control member being mounted in the bore for longitudinal sliding movement in order to engage the actuating member for movement thereof; and wherein the housing body includes a further valve chamber spaced along the longitudinal axis of the gas flow passage from the bore, the further valve chamber communicating with and extending laterally of the gas flow passage, with a regulator valve mounted in the further valve chamber and operable to regulate flow of gas through the gas flow passage from the inlet to the outlet.

15. The control assembly as claimed in claim 14, wherein the gas flow passage includes a guideway and the actuating member is mounted in the guideway for guided sliding movement thereby to operate the safety valve.

16. The control assembly as claimed in claim 15, wherein the actuating member is an actuating spool having a port therethrough for flow of gas along the gas flow passage from the inlet to the outlet.

17. The control assembly as claimed in claim 16, wherein the actuating member has an actuating surface at one end thereof which engages the safety valve for movement of the safety valve.

18. The control assembly as claimed in claim 17, wherein the actuating spool has a tab extending from one end thereof, and the tab provides the actuating surface.

19. The control assembly as claimed in claim 14, wherein the actuating member has a control surface, and the control member contacts the control surface for movement of the actuating member.

20. The control assembly as claimed in claim 19, wherein the actuating member is an actuating spool having a port therethrough for flow of gas along the gas flow passage from the inlet to the outlet, wherein the actuating member has a tab forming an actuating surface at one end thereof which engages the safety valve for movement of the safety valve, and wherein the control surface is cammed to transmit movement of the control member to the actuating member.

21. The control assembly as claimed in claim 20, wherein the spool has a tang remote from the tab, and the tang provides the control surface.

22. The control assembly as claimed in claim 14, wherein the actuating member and control member are slidably movable along respective axes extending perpendicular to one another.

23. The control assembly as claimed in claim 14, wherein the regulator valve includes an elongate control key rotatable about a longitudinal axis to operate the regulator valve for regulating flow of gas.

24. The control assembly as claimed in claim 14, wherein the housing body is manufactured from metal bar stock material.

25. The control assembly as claimed in claim 14, wherein the further valve chamber opens into the gas flow passage adjacent the outlet, and the outlet extends laterally to the guideway.

26. A gas control assembly for use with a gas burner, the gas control assembly comprising:

an elongate housing body having a gas inlet for communication with a gas manifold, a gas outlet for directing a regulated flow of gas to a burner, and a longitudinally extending gas flow passage between the inlet and outlet;

wherein said housing body includes an integral safety valve and an integral regulator valve between said inlet and outlet;

wherein said safety valve is mounted in a valve chamber of the gas flow passage and is operable to move along the longitudinal axis of the gas flow passage for controlling the flow of gas through the assembly based on a safety condition;

wherein said regulator valve is mounted at an end of the gas flow passage distal from said safety valve, the regulator valve being rotatable about an axis transverse to the longitudinal axis of the gas passage to control the flow of gas through the assembly to provide a desired gas flow to the burner;

wherein an override actuator is provided in a guideway of said gas flow passage intermediate said safety valve and said regulator valve, said actuator being movable by a control member to open said safety valve, said control member extending parallel to said regulator valve within a bore in said housing body transverse to said guideway;

wherein said body includes a port in said safety valve chamber that is transverse to said longitudinal axis of said gas flow passage, said port providing said inlet or outlet of said housing.

27. The assembly of claim 26, wherein the body includes a port that extends from the regulator valve transversely of the gas passage, said port providing the other of said inlet or outlet.

28. The assembly of claim 26, wherein said inlet and outlet extend laterally from opposite sides of said gas flow passage.

29. The assembly of claim 26, wherein said body is of metal bar stock.

30. The assembly of claim 26, wherein the actuator is a hollow sleeve.

31. The assembly of claim 30, wherein the actuator has a tab at one end for engaging the safety valve.

32. The assembly of claim 30, wherein the actuator has a tang extending into said sleeve, said tang defining a control surface on which said control member acts.

33. The assembly of claim 26, wherein said regulator valve includes a plug mounted opposite to said gas passage and a key extending from said plug out of said housing body.

34. The assembly of claim 33, wherein a press member is slidably mounted on said key for engaging with said control member to move said actuator to open said safety valve.

35. The assembly of claim 33, wherein said plug has a side gas inlet and a side gas outlet.

36. The assembly of claim 26, wherein said port in said safety valve chamber provides said gas inlet, and said gas outlet is adjacent said regulator valve.

37. A gas control assembly for use with a gas burner, the assembly comprising:

an elongate housing body having a gas inlet for communication with a gas manifold, a gas outlet for directing a regulated flow of gas to a burner, and a longitudinally extending gas flow passage between the inlet and outlet;

a safety valve mounted in a valve chamber of the gas flow passage and operable to move along the longitudinal axis of the gas passage for controlling the flow of gas through the assembly based on a safety condition;

a regulator valve mounted at an end of the gas flow passage that is distal from safety valve, the regulator valve being rotatable about an axis transverse to the longitudinal axis of the gas passage to control the flow of gas through the assembly to provide a desired gas flow to the burner;

wherein said inlet and outlet extend from opposite sides of said gas flow passage in directions transverse to said longitudinal axis of said gas flow passage and are offset from one another in the longitudinal direction of said gas passage; and wherein said inlet, outlet and gas passage extend in a common plane transverse to the rotational axis of said regulator valve.

38. Gas supply apparatus comprising a gas manifold having a longitudinal axis and one or more outlets spaced along the length thereof, each outlet having a control assembly mounted adjacent thereto, wherein:

each control assembly includes an elongate housing body having a longitudinal axis that lies parallel to the longitudinal axis of said manifold;

each said body including an inlet transverse to said longitudinal body axis that communicates with a said manifold outlet, an outlet for communicating with a gas burner, and a gas passage extending along said longitudinal axis of said body between said body inlet and body outlet;

each control assembly includes a safety valve mounted in said gas passage for controlling the flow of gas based on a safety condition, said safety valve extending along said longitudinal axis of said body, parallel to said longitudinal axis of said manifold; and each control assembly includes a regulator valve mounted transversely to said safety valve for controlling the desired gas flow to a gas burner.

39. A gas control assembly for use with a gas burner, the assembly comprising:

a housing including a body having a gas inlet for communication with a gas source, a gas outlet for directing a regulated flow of gas to a burner, and a gas flow passage between the inlet and outlet;

a safety valve mounted in the gas flow passage and operable to control the flow of gas through the assembly based on a safety condition;

an actuating member mounted in a guideway in the gas flow passage for opening the safety valve to override the safety valve; and a control member mounted in the housing body transversely to the actuating member for engaging the actuating member to move the actuating member along the guideway to open the safety valve;

wherein the actuating member is a hollow spool having a port through which gas flows in use, wherein the spool has a tab at one end that extends inwardly from an edge of said port and that engages with the safety valve to open the safety valve when the actuating member is moved by said control member, and wherein said spool has a tang extending inwardly into said hollow spool at an angle to the direction of spool travel, said tang defining a control surface with which the control member engages in order to move the actuating member to open the safety valve.

40. The assembly of claim 39, wherein the body includes a regulator valve mounted in the gas flow passage and operable to control the flow of gas through the assembly to provide a desired gas flow to the burner, the actuating member and guideway being provided between the safety valve and the regulator valve.

41. A gas control assembly for use with a gas burner, the gas control currently comprising:

an elongate housing body having a gas inlet for communication with a gas manifold, a gas outlet for directing a regulated flow of gas to a burner, and a longitudinally extending gas flow passage between the inlet and outlet;

wherein the housing body includes an integral safety valve and an integral regulator valve between said inlet and outlet;

wherein said safety valve is mounted in a valve chamber of the gas flow passage and is operable to move along the longitudinal axis of the gas flow passage for controlling the flow of gas through the assembly based on a safety condition;

wherein an override actuator is provided in a guideway of said gas flow passage intermediate said safety valve and said regulator valve, said actuator being movable by a control member to open said safety valve, said control member extending parallel to said regulator valve within a bore of said housing body transverse to said guideway; and wherein said regulator valve comprises a conical plug and an elongate key for rotating said plug, said plug being mounted for rotation in a plug chamber of said housing body directly adjacent the end of the gas flow passage distal from the safety valve, and said key extending transversely to said gas flow passage.

* * * * *